United States Patent [19]

Mascotte

[11] Patent Number: 4,663,950

[45] Date of Patent: May 12, 1987

[54] LOCKING SYSTEM FOR SECURITY DOOR AND WINDOW

[75] Inventor: Lawrence L. Mascotte, Portland, Oreg.

[73] Assignee: Rayma Development Corp., Portland, Oreg.

[21] Appl. No.: 767,889

[22] Filed: Aug. 21, 1985

[51] Int. Cl.[4] ..... E05B 65/06

[52] U.S. Cl. ..... 70/135; 70/137; 70/139; 70/416

[58] Field of Search ..... 70/139, 56, 416, 418, 70/135, 137; 292/97, 196, 222, 223, 336.3, 336.5

[56] References Cited

U.S. PATENT DOCUMENTS

| | | | |
|---|---|---|---|
| 1,528,515 | 3/1925 | Taylor | 70/139 |
| 1,685,317 | 9/1928 | Devereaux | 292/336.5 |
| 1,837,431 | 12/1931 | Grund | 70/DIG. 31 |
| 2,617,288 | 11/1952 | Hinds | 70/139 |
| 2,854,839 | 10/1958 | Eads | 70/139 |
| 3,414,306 | 12/1968 | Bernstein | 70/416 |
| 3,695,068 | 10/1972 | Eads et al. | 70/107 |
| 3,899,906 | 8/1975 | Bradstock | 70/139 |
| 3,990,182 | 11/1976 | Linder | 70/56 |
| 4,106,315 | 8/1978 | Dohanyos | 70/56 |
| 4,127,016 | 11/1978 | Ibsen | 70/139 |
| 4,218,903 | 8/1980 | Eads | 70/139 |
| 4,475,364 | 10/1984 | Frank | 292/336.5 |
| 4,503,692 | 3/1985 | Grint | 70/417 |
| 4,569,547 | 2/1986 | Fayerman et al. | 292/336.3 |

FOREIGN PATENT DOCUMENTS

| | | | |
|---|---|---|---|
| 0004849 | 10/1979 | European Pat. Off. | 70/139 |
| 2507547 | 8/1975 | Fed. Rep. of Germany | 70/139 |
| 2833865 | 2/1980 | Fed. Rep. of Germany | 70/139 |
| 435274 | 9/1935 | United Kingdom | 70/416 |

*Primary Examiner*—Thomas J. Holko
*Assistant Examiner*—Suzanne L. Dino
*Attorney, Agent, or Firm*—Adrian J. LaRue

[57] ABSTRACT

A locking system for security door or window includes a metal frame secured onto a house around the door or window. A lock is disposed in the metal frame and has a movable locking member that is movable between a locked position in engagement with a stationary locking member in the door or window when in a closed position in the frame and an unlocked position. A manually-actuated member extends through the metal frame and a hole in the door or window frame and includes an operating member inside the house and also within a guard secured onto the inside of the door or window frame enabling the operating member to be operated through an opening in the guard that opens away from the door or window opening to manually operate the lock from inside the house and prevents anyone from gaining access to the operating member.

15 Claims, 8 Drawing Figures

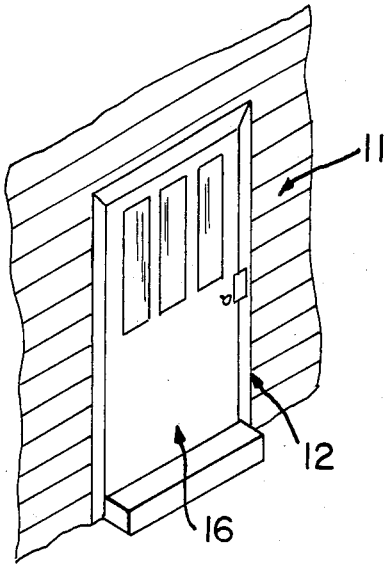
F I G. 1
F I G. 2
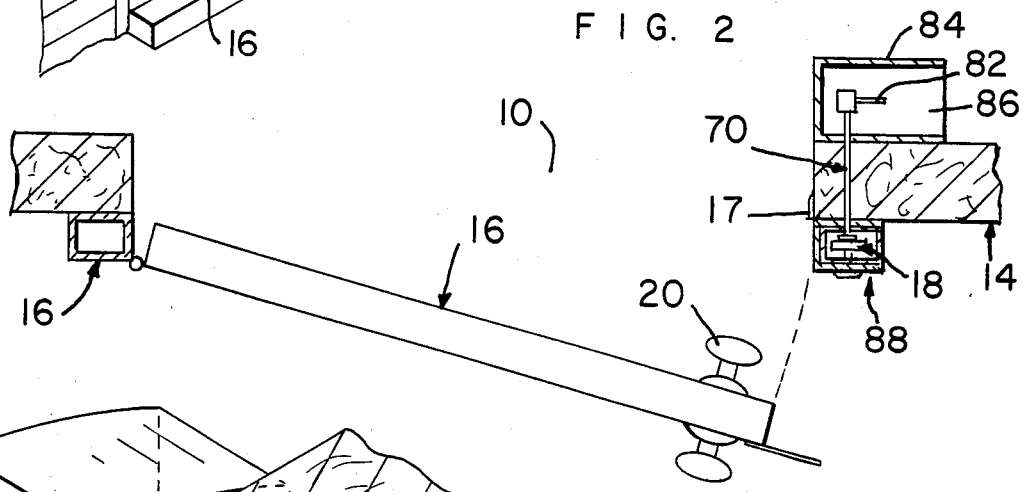
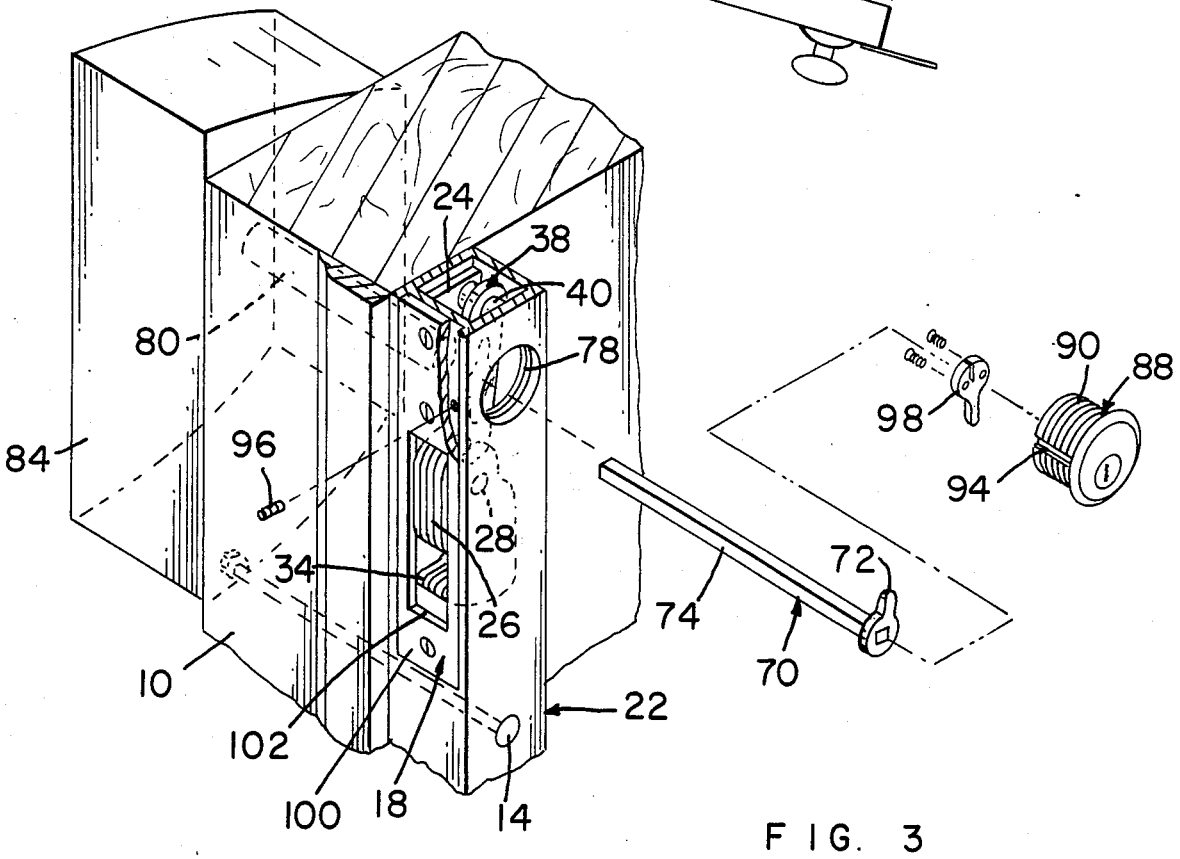
F I G. 3

LOCKING SYSTEM FOR SECURITY DOOR AND WINDOW

FIELD OF THE INVENTION

The present invention relates to locking systems and more particularly to locking systems for security doors and windows.

BACKGROUND OF THE INVENTION

Locking systems of the dead bolt type are in current use on doors especially in houses. A key is needed to unlock the locking system and a thumb member is located on the inside to operate the locking system. This is required because of local code requirements to enable a person to unlock the door from the inside in case of an emergency, such as a fire.

Security doors are being added to existing houses to prevent them from being burglarized and these doors also function as storm doors and screen doors. A dead bolt lock with a thumb member on the inside is not acceptable because the glass in the storm door or the screen in the screen door can be broken or torn enabling a person who wants to break into the house to operate the thumb member and unlock the dead bolt lock and gain access to the house.

SUMMARY OF THE INVENTION

According to the present invention, a locking system comprises a frame secured around a window or door of a house, a lock is mounted in the frame and includes a movable locking member that is positioned within the lock in an unlocked position and is movable out of the lock to a lock position engaging a stationary locking member in the door or window guard when the door or window guard is positioned within the frame thereby locking the door or window guard in the closed position. From the outside, a key-operated member as part of the lock operatively engages the movable locking member and moves the movable locking member to a locked position out of the lock or to an unlocked position within the lock. From the inside, a manually-operated member as part of the lock operatively engages the movable locking member and moves the movable locking member to the locked or unlocked positions. The manually-operated member extends through the wall of the house along side of the door or window frame to the inside of the house thereby operating the movable locking member. A guard is mounted on an inside of the door frame covering an operating member of the manually-operated member and it has an opening for enabling the operating member to be operated; the opening opens away from the door frame to prevent outside access to the operating member.

According to another aspect of the present invention, a lock has a movable locking member pivotally mounted in a housing, a lever has one end pivotally mounted to the housing while the other end has a pin disposed in an opening in the movable locking member to move the locking member between locked and unlocked positions during movement of the lever. A spring-biased pin is movably mounted in a lower slot of the lever and is normally biased against stationary pins in the lever on each side of the lower slot while the ends of the spring-biased pin are disposed in U-shaped slots in the housing A round slot and elongated upper slot as part of the lower slot in the lever enables a manually-operated member to be passed through the housing and round and upper slots in the lever so as to position a lever-operating member on the far side of the lever so that upon manual operation of the manually-operated member, the lever-operating member engages the spring-biased pin and stationary pins thereby moving the spring-biased pin along the lower slot and the ends o the spring-biased pin along the U-shaped slots which move the lever thereby causing the pin in the other end of the lever to move the movable locking member between the locked and unlocked positions. A key-operated member is secured in the housing and includes another lever-operating member positioned on the near side of the lever, the other lever-operating member is operated by a key to move the movable locking member between the locked and unlocked positions in the same manner as the far side lever-operating member.

BRIEF DESCRIPTION OF THE DRAWINGS

FIG. 1 is a part perspective view of a house including a door.

FIG. 2 is a cross-sectional view of FIG. 1 showing the door in a part opened position.

FIG. 3 is a part perspective view of the door frame and the locking system with operating parts of the locking system exploded therefrom.

DETAILED DESCRIPTION OF THE INVENTION

Figure 4:
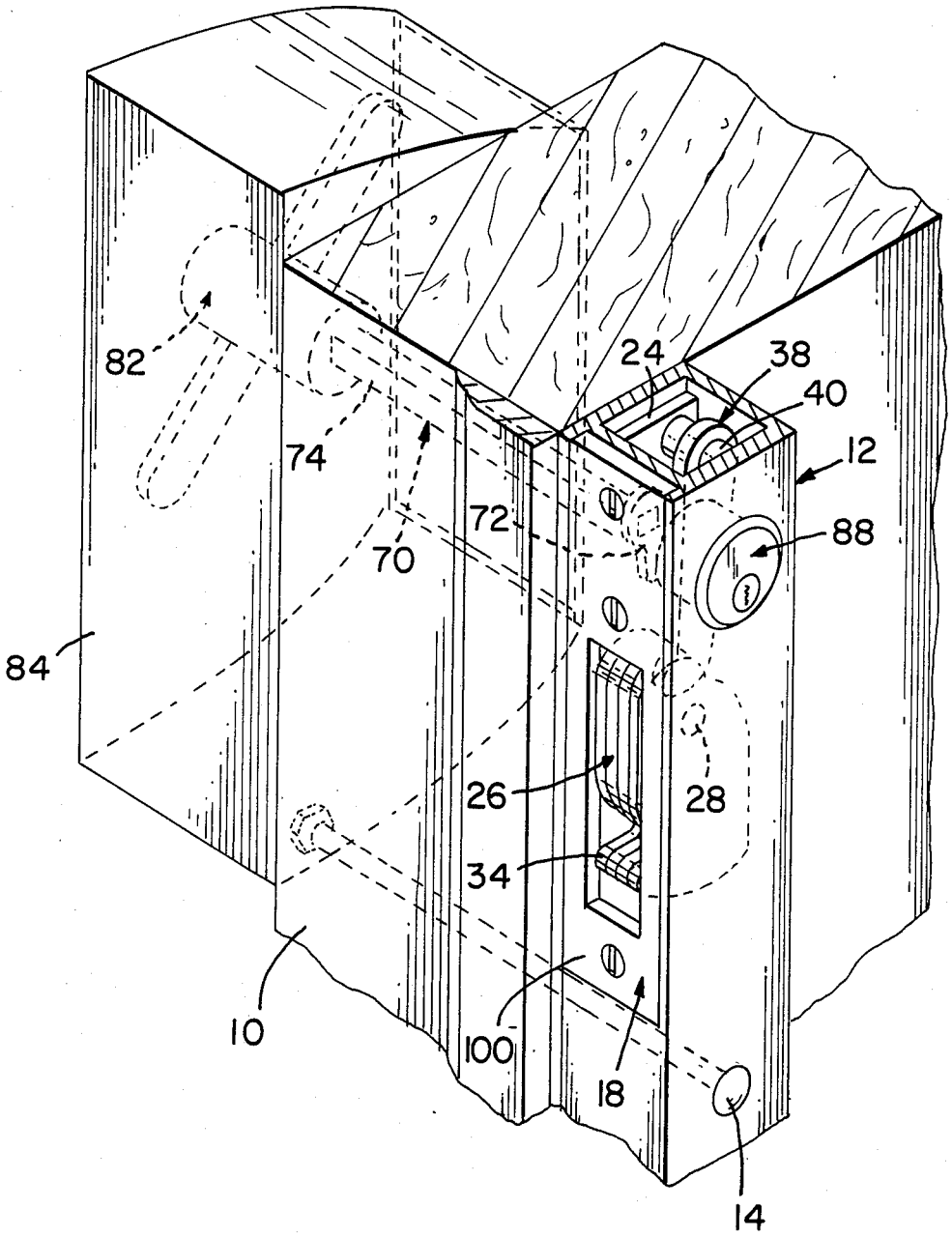
FIG. 4 is similar to FIG. 3 but showing the locking system assembled.

As shown in FIGS. 1 and 2, a house H has a doorway 10 around the outside of which is secured a hollow metal frame 12. Hardened one way lag bolts 14 as shown in FIGS. 3 and 4 ar used to extend through frame 12 and screw into the door frame which secured metal frame 12 in position and prevents removal. A security door 16 is hingedly mounted onto frame 12 and is locked in a closed position therein by lock 18 mounted in an opening in frame 12. Door 16 has a metal frame and is preferably used as a storm door in winter and a screen door in spring, summer and fall. Door 16 also has a handle 20 and an associated conventional latching bolt (not shown) to maintain door 16 closed without locking the door against a stop 17 on the door Lock 18 includes a housing which comprises metal side plates 22, 24 between which a movable locking member 26 is pivotally mounted on a pivot member 28. A front metal plate 23 is connected to side plates 22, 24. Locking member 26 comprises pairs of metal plates 30 of the same configuration secured on each side of a central plate 32; the central plate 32 having the same configuration as the pairs of metal plates 30 from pivot pin 28 downwardly so that a space is provided between the pairs of plates 30 above pivot pin 28. A locking area 34 is provided in locking member 26.

Figure 7:
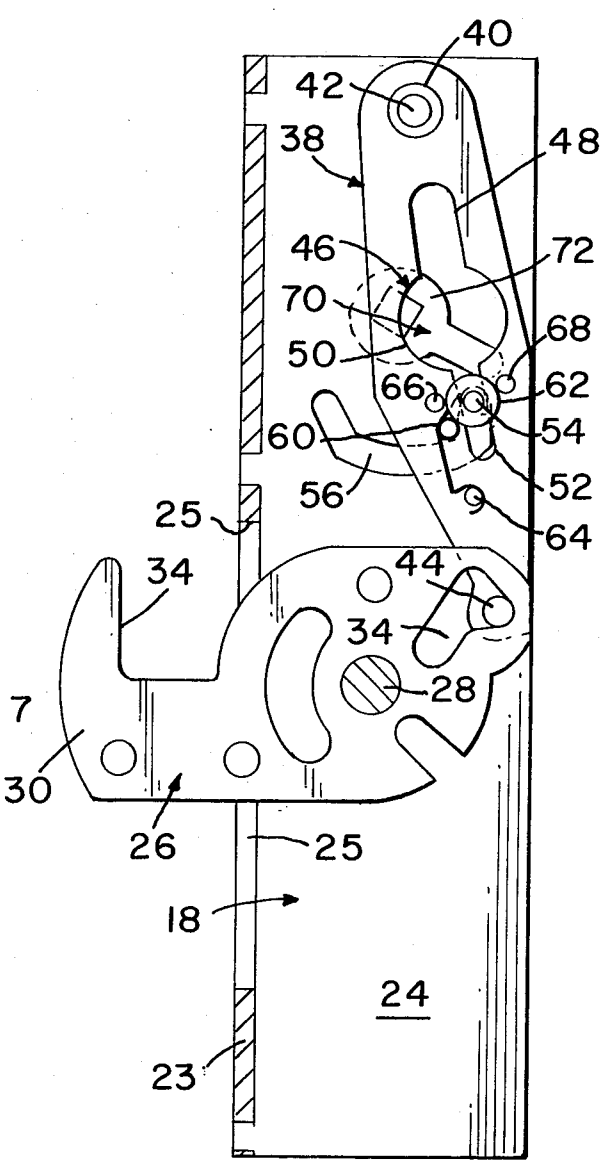
FIGS. 5–7 are views with one side plate of the lock housing removed showing the operation of the lock via the manually-operated member.
Figure 6:
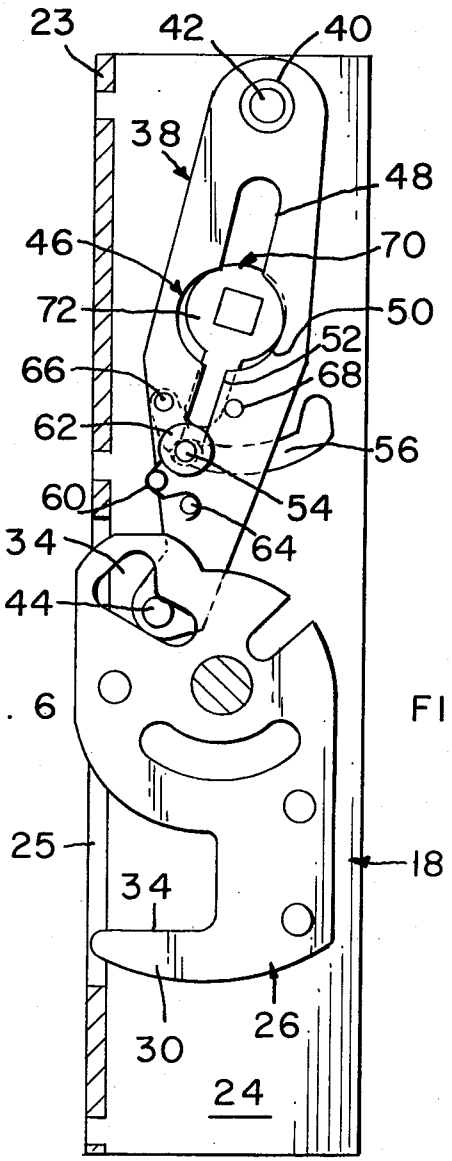
Figure 5:
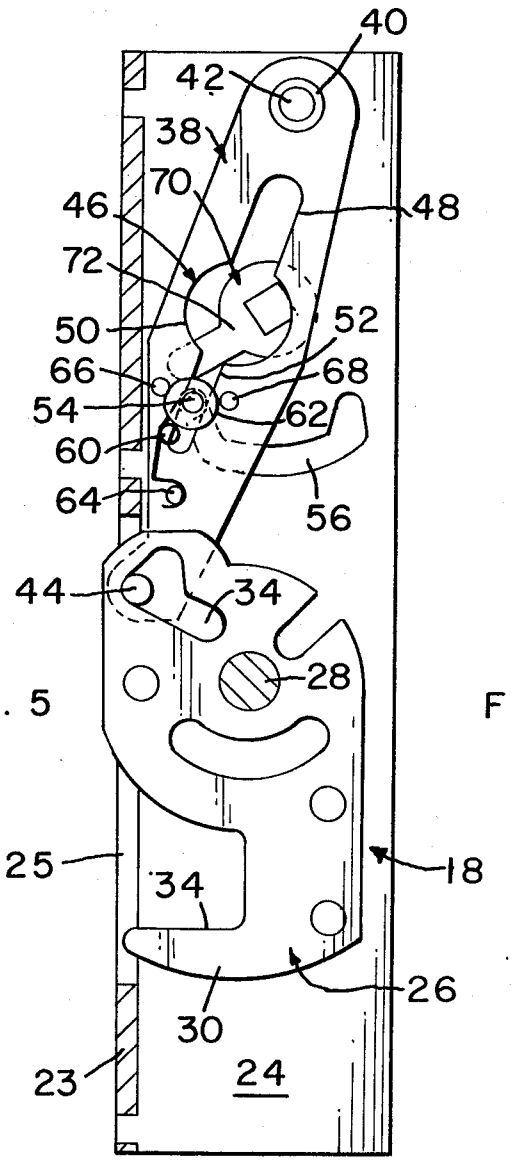

As shown in FIGS. 5–7, pairs of plates 30 have aligned L-shaped openings 36. A lever 38 has an upper end secured onto a collar 40 that is freely mounted on a pin 42 that has its ends secured in plates 22, 24. The free end of lever 38 is disposed in the space between the pairs of plates 30 of locking member 26 and a pin 44 secured in the free end of lever 38 has a respective section on each side of lever 38 disposed in L-shaped openings 36 of each respective pair of plates 30.

An opening 46 is located in lever 38 between collar 40 and pin 44 and includes an upper slot 48, a round hole 50 and a lower slot 52 all in communication; upper slot 48 is larger than lower slot 52.

A pin 54 is movably disposed in lower slot 52 and its ends are disposed in respective aligned U-shaped slots 56 located in plates 22, 24. As shown in FIGS. 5–7, each of U-shaped slots 56 has a left inclined leg, an arcuate bight and a substantially straight right leg.

Figure 8:
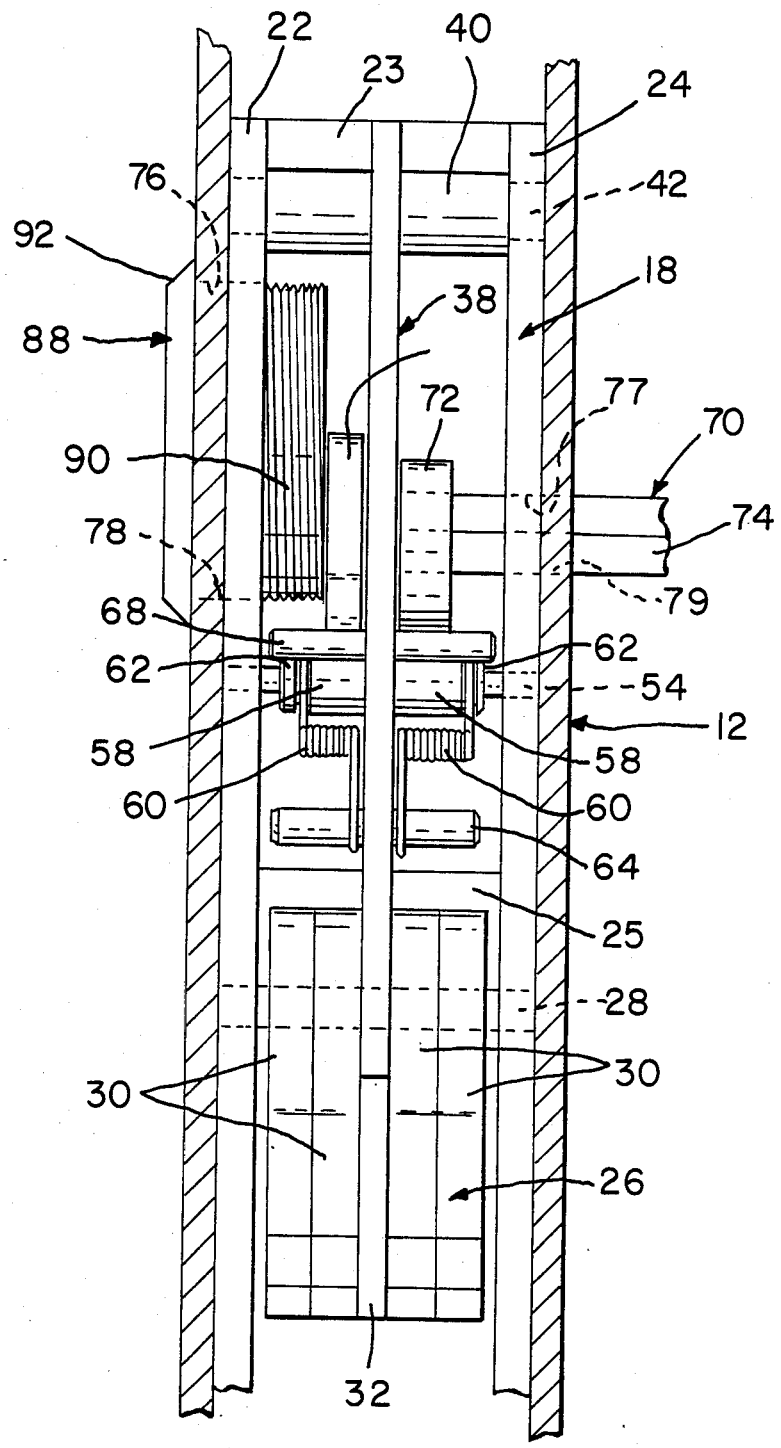
FIG. 8 is a rear view of the lock with the locking member in a locked position.

Roller members 58 are mounted on pin 54 on each side of lever 38 as shown in FIG. 8 while one hooked end of coil springs 60 is disposed onto pin 54 between respective rollers 58 and washer member 62 that are press-fitted onto pin 54. The other hooked ends of springs 60 are disposed onto pin 64 press-fitted into a hole in lever 38. The action of springs 60 biases rollers 58 against pins 66, 68 press-fitted into holes in lever 38 on each side of lower slot 52 adjacent its upper end so that the pin assembly of pin 54, rollers 58 and washer members 62 are movably maintained in lower slot 52 while the ends of pin 54 are disposed in and movable along respective U-shaped slots 56 as described hereafter.

A manually-actuated member 70 as shown in FIGS. 2–8, includes a lever-actuating member 72 and a shaft 74 secured thereto. As can be discerned, lever-actuating member 72 has a round section secured to shaft 74 and a lobe with rounded end.

With lever 38 in the middle of U-shaped slots 56, shaft 74 is moved through an opening 76 in frame 12, an opening 78 in plate 22, round slot 50 in lever 38, a hole 77 in plate 24, a hole 79 in frame 12, a hole 80 in the door frame and a hole in a guard 84. This enables lever-actuating member 72 in the position as shown in FIG. 3 to pass through round slot 50 and upper slot 48 until it is on the other side of lever 38 between lever 38 and plate 24 as shown in FIGS. 5–8. The inner end of shaft 74 is located on the inside of the door frame and an operating member 82 is secured thereto as shown in FIGS. 2 and 4 and is positioned within guard 84 which has an opening 86 that opens away from the door 16. Thus, if someone breaks the glass or cuts the screen in door 16, access to operating member 82 is not possible because it would be impossible for a person to reach around guard 84 through opening 86 and operate operating member 82. Lag bolt 14 also extends through the door frame and serves to secure guard 84 in position on the inside of the door frame.

To operate lock 18 via manually-actuated member 70, reference is made to FIGS. 5–7. As shown in FIG. 5, movable locking member 26 is in an unlocked position with the ends of pin 54 located in the left leg of U-shaped slots 56. As manually-actuated member 70 is turned counter clockwise, the lobe of lever-actuating member 72 engages roller 58 causing pin 54 to move downwardly on lower slot 52 and also along the left leg of U-shaped slots 56 against the bias of springs 60 which also moves lever 38 toward the right causing pin 44 to move along about halfway along the left leg of L-shaped opening 36 in movable locking member 26. When the ends of pin 54 reach the arcuate bights of U-shaped slots 56, the lobe of lever-actuating member 72 engages pin 68 and moves lever 38 further to the right until the ends of pin 54 reach the right leg of U-shaped slots 56 which causes pin 44 to have moved to the end of the left leg of L-shaped opening 36 and back to a little ove halfway therealong which also causes movable lock member 26 to be moved to a locked position in engagement with a stationary lock member (not shown) in door 16 as shown in FIG. 7. At this position, the spring forces of springa 60 move the ends of pin 54 along the right legs of U-shaped slots 56 to the ends thereof thereby moving lever 38 to its rightmost position as shown in FIG. 7 and pin 44 is now positioned in the right leg of L-shaped opening 36 of movable lock member 26. This prevents movable lock member 26 from being moved unless by operation of actuating member 82 inside guard 84 inside the house or by a key-actuated member outside the house. Reverse operation of actuating member 82 moves movable locking member 26 back to an unlocked position as shown in FIG. 5 with the lobe of lever-actuating member 72 engaging pin 66 after engagement with roller 58 to effect this operation.

A key-actuating member 88 as shown in FIGS. 2–4 and 8 includes a cylindrical member 90 having external threads to enable it to engage threads in opening 78 of plate 22 thereby positioning member 90 in position until beveled flange 92 engages frame 12. At this point member 90 is moved slightly backwardly until groove 94 is lined up with set screw 96 in front plate 23 connecting plate 22, 24 as shown in FIG. 3 thereby securing member 90 in position. A lever-actuating member 98 is part of the key-actuating system of key-actuating member 88 and is of the same configuration as lever-operating member 72 and operates in the same manner when a key is used to operate the lock. Thus no further explanation is deemed to be necessary to describe the operation of the lock in conjunction with key-actuating member 88. A plate 100 as shown in FIGS. 3 and 4 is screwed onto front plate 23 of the lock to protect set screw 96 and it has an opening 102 in coincidence with a like opening 25 in front plate 23 to permit movable locking member 26 to move in and out of lock 18.

From the foregoing, a unique locking system for a security door has been described and illustrated. The same locking system can also be used in conjunction with one or more windows over which a security window is hingedly mounted onto a frame to permit an alternative escape from the house in case of not being able to reach the front door during an emergency. Moreover, the locking system enables a shaft of a manually-operated member to be passed through a slot in a lever of the lock and a hole in the door frame while the lock is secured in the frame surrounding the door or window so that a lever-actuating member secured to the shaft also passes a through the slot in the lever and be positioned on the inside of the lever between the lever and the lock housing so that the manually-operated member can be operated inside a guard inside the house thereby manually operating the lock.

I claim:

1. A lock for use in a frame secured onto a building surrounding a door or window, comprising;

a housing member mounted in an opening of the frame and having a movable locking member for movement between a locked position and an unlocked position, aligned openings in said housing member that will be in alignment with aligned openings in the frame;

lever means having one end pivotally mounted in said housing member;

means between the other end of said lever means and said movable locking member for moving the movable locking member upon movement of said lever means between the locked and unlocked positions, said lever means having opening means therein in the form of upper and lower slot means in communication with a center slot means, said opening means being alignable with the aligned openings enabling manually-operated means including manual-operating means to be passed through the aligned openings and opening means and through a hole in the door or window frame with the manual-operating means being disposed on the inside of said lever means between said lever means and said housing member;

pin assembly means movably mounted on aid lever means for engagement by said manual-operated means when said manually-operated means is operated from inside the housing causing said manual-operating means to operate said pin assembly means thereby moving said lever means which in turn moves the movable locking member between the locked and unlocked positions; and key-actuated means disposed in the outer aligned openings in the frame and the housing member and including key-operated means for engaging the pin assembly means thereby moving said pin assembly means and said lever means which in turn moves the movable locking member between the locked and unlocked positions.

2. A lock as claimed in claim 1, wherein said manual-operating means has a round section and a lobe section that fits through said upper slot means and said round slot means when said manual-operating means paases through said opening means.

3. A lock as claimed in claim 1, wherein said pin assembly means includes a pin member disposed in said lower slot means, roller members mounted on said pin member on each side of said lever means, the ends of said pin member disposed in respective aligned U-shaped slot means in said housing member, pin members in said lever means on each side of said lower slot means, and spring means disposed between said pin member and said lever means normally biassing said roller members against said pin members and into either leg of said U-shaped slot means.

4. A lock as claimed in claim 1, wherein a guard means is mountable on an inside of the door or window frame with an opening that opens away from the door or window frame and an operating member is mounted on the end of said manually-operated means within said guard means and is accessible through the opening to operate said manually-operated means.

5. A locking system for a door or window of a building, comprising:

a metal frame securable onto the building around the door or window, a door or window guard hingedly mounted onto the frame and having a stationary locking member;

a lock is mounted in the metal frame and includes a housing member having a movable locking member that is movable between an unlocked position and a locked position engaging the stationary locking member when the door or window guard is in a closed position within the frame thereby locking the door or window guard in the closed position;

means in said lock operatively connected to said movable locking member to move the movable locking member between the unlocked and locked positions, said operatively-connected means comprises lever means having one end pivotally connected to said housing member while the other end contains a pin disposed in a L-shaped opening in said movable locking member, said lever means has slot means in which pin assembly means in movably mounted, said pin assembly means including pin means and spring means, said spring means disposed between said pin means and said lever means and normally biassing said pin means against pin members on said lever means adjacent said slot means;

key-operated means provided by said lock and accessible from outside the door or window guard including key-actuated means engagable with said operatively-connected means to operate said operatively-connected means thereby moving said movable locking member between the locked and unlocked positions;

manually-operated means provided by said lock and having manually-actuating means accessible from inside the building and including manually-actuated means engagable with said operatively-connected means to operate said operatively-connected means thereby moving said movable locking member between the locked and unlocked positions, said manually-operated means including means extending through a hole in the door or window frame connecting the manually-actuating means and said manually-actuated means; and guard means mounted on the inner door or window frame covering said manually-actuating means and having an opening that opens away from the door or window frame for engaging and operating said manually-actuating means from inside the building but preventing anyone from engaging and operating the manually-actuating means from outside the building, said slot means has a lower slot in which said pin means is movably disposed, a round slot and an upper slot, said connecting means being movable through first openings in said frame and housing member, through the round slot, through second openings in said housing member and frame and through the hole in the door or window frame while the manually-actuated means also passes through the first openings and through the round and upper slots and being disposed on the inner side of said lever means between said lever means and said housing member so that said manually-actuated means engages said pin means and the pin members thereby moving said lever means and movable locking member between the locked and unlocked positions when said manually-actuating means operates said manually-actuated means through the opening in said guard means inside the building.

6. A locking system as claimed in claim 5, wherein said housing member has U-shaped slot means in which ends of said pin means are respectively disposed, the ends of the pin means being disposed in respective legs of the U-shaped slot means to maintain the movable locking member in the locked or unlocked position and an arcuate bight of the U-shaped slot means serving to move the movable locking member between the locked and unlocked positions in conjunction with the key-actuated means or the manually-actuated means engaging the pin means and pin members thereby moving said lever means and the pin in said L-shaped opening.

7. A locking system for a door or window of a building, comprising:

a metal frame securable onto the building around the door or window and having outer and inner aligned openings;

a door or window guard hingedly mounted onto the frame and having a stationary locking member;

a locking mounted in the metal frame and including a housing having a movable locking member that is movable between an unlocked position and a locked position engaging the stationary locking member when the door or window guard is in a closed position within the frame thereby locking the door or window guard in the closed position, said housing having aligned openings in alignment with the frame aligned opeings;

lever means pivotally mounted onto said housing and having opening means in the form of upper and lower slot means in communication with a center slot means, said opening means being alignable with the aligned openings in the housing and frame;

means between said lever means and said movable locking member for moving said movable locking member between the locked and unlocked positions when said lever means is moved between a first position and a second position;

manually-operated means having shaft means and lever-operating means passable through the outer aligned openings in the frame and housing and through the opening means in said lever means with the shaft means extending along the inner aligned openings of the housing and frame and a hole in the door or window frame with the lever-operating means being disposed between said lever means and said housing; and means movably mounted on said lever means for engagement by said lever-operating means when said shaft means is operated from inside the building causing said lever-operating means to operate said movably mounted means thereby moving said lever means between the first and second positions which in turn moves the movable locking member between the locked and unlocked positions.

8. A locking system as claimed in claim 7, wherein key-operated means is provided by said lock and is accessible from outside the door or window guard and includes key-actuated means engagable with said movably mounted means, said key-actuated means operates said movably mounted means thereby moving said lever means between the first and second positions which in turn moves the movable locking member between the locked and unlocked positions.

9. A locking system as claimed in claim 7, wherein guard means is mounted on the inner door or window frame covering an operating member mounted on said shaft means, said guard means, having an opening that opens away from the door or window frame for engaging and operating the operating member from inside the building but preventing anyone from engaging and operating the operating member from outside the building.

10. A locking system as claimed in claim 7, wherein said opening means in said lever means has slot means in which said movably mounted means is mounted, and spring means is disposed between said movably mounted means and said lever means normally biassing said movably mounted means against stop means.

11. A locking system as claimed in claim 7, wherein said opening means has slot means through which said lever-operating means passes.

12. A lock for use in a frame secured onto a building surrounding a door or window, comprising:

housing means mountable in an opening of the frame; said housing means having aligned openings that are in alignment with aligned openings in the frame when the housing means is in position in the frame opening;

movable locking means mounted onto said housing means for movement between a locked position and an unlocked position;

lever means pivotally mounted onto said housing means and having opening means in the form of upper and lower slot means in communication with a center slot means, said opening means being alignable with the aligned openings in the housing means and frame;

means between said lever means and said movable locking means for moving said movable locking means between the locked and unlocked positions when said lever seans is moved between a first position and a second position;

manually-operated means having shaft means and lever-operating means passable through outer aligned openings in the frame and housing means and through the opening means in said lever means with the shaft means extending along inner aligned openings in the housing means and frame and a hole in the door or window frame with the lever-operating means being disposed between said lever means and said housing means; and means movably mounted on said lever means for engagement by said lever-operating means when said shaft means is operated from inside the building causing said lever-operating means to operate said movably mounted means thereby moving said lever means between the first position to the second position which in turn moves the movable locking means between the locked and unlocked positions.

13. A lock as claimed in claim 12, wherein said opening means in said lever means has slot means in which said movably mounted means is mounted, and spring means is disposed between said movably mounted means and said lever means normally biassing said movably mounted means against stop means.

14. A lock as claimed in claim 12, wherein key-operated means is mounted in said housing means and is accessible from outside the building and includes key-actuated means engagable with said movably mounted means, said key-actuated means operates said movably mounted means thereby moving said lever means between the first and second positions which in turn moves the movable locking means between the locked and unlocked positions.

15. A lock as claimed in claim 12, wherein guard means is mountable on an inside of the door or window frame with an opening that opens away from the door or window frame and an operating member is mounted on the shaft means within said guard means and is accessible through the opening to operate said manually-operated means from inside the building but preventing anyone from engaging and operating the operating member from outside the building.

* * * * *